US008413455B2

(12) United States Patent
Sim et al.

(10) Patent No.: US 8,413,455 B2
(45) Date of Patent: Apr. 9, 2013

(54) AIR CONDITIONING SYSTEM

(75) Inventors: Jae Hoon Sim, Seoul (KR); Deok Huh, Seoul (KR); Seung Hee Ryu, Seoul (KR); Seong Won Bae, Seoul (KR)

(73) Assignee: LG Electronics Inc., Seoul (KR)

( * ) Notice: Subject to any disclaimer, the term of this patent is extended or adjusted under 35 U.S.C. 154(b) by 757 days.

(21) Appl. No.: 12/614,776

(22) Filed: Nov. 9, 2009

(65) Prior Publication Data

US 2010/0115976 A1 May 13, 2010

(30) Foreign Application Priority Data

Nov. 10, 2008 (KR) ..... 10-2008-0111318

(51) Int. Cl.
*F25B 41/04* (2006.01)
*F25B 49/00* (2006.01)
*F25D 21/06* (2006.01)

(52) U.S. Cl.
USPC ..... 62/196.1; 62/151; 62/196.4; 62/197; 62/278

(58) Field of Classification Search ..... 62/151, 62/160, 196.1, 196.4, 197, 199, 277, 278
See application file for complete search history.

(56) References Cited

U.S. PATENT DOCUMENTS

| | | | | |
|---|---|---|---|---|
| 4,628,706 | A * | 12/1986 | Neudorfer | 62/278 |
| 4,770,000 | A * | 9/1988 | Kuroda et al. | 62/156 |
| 4,854,130 | A | 8/1989 | Naruse et al. | |
| 4,959,971 | A | 10/1990 | Minari | |
| 5,319,940 | A | 6/1994 | Yakaski | |

FOREIGN PATENT DOCUMENTS

| | | |
|---|---|---|
| CN | 1916538 | 2/2007 |
| DE | 10-2006-024796 | 9/2007 |
| EP | 1 645 817 | 4/2006 |
| WO | WO 97/24565 | 7/1997 |

OTHER PUBLICATIONS

Office Action issued in Chinese Application No. 200910207926.7 dated Jul. 29, 2011.
European Search Report issued in EP Application No. 09173387.3 dated Mar. 4, 2010.

* cited by examiner

*Primary Examiner* — Marc Norman
(74) *Attorney, Agent, or Firm* — KED & Associates, LLP

(57) ABSTRACT

An air conditioning system is provided. The air conditioning system allows coolant to selectively flow through a series of bypass pipes and valves connecting an outlet of a compressor and an outlet of an expansion member. The series of bypass pipes and valves allow a defrosting function to be performed without performing a reverse cycle.

10 Claims, 3 Drawing Sheets

AIR CONDITIONING SYSTEM

CROSS-REFERENCE TO RELATED APPLICATIONS

Priority is claimed under 35 U.S.C. 119 and 35 U.S.C. 365 to Korean Patent Application No. 10-2008-0111318 (filed in Korea on Nov. 11, 2008), which is hereby incorporated by reference in its entirety.

BACKGROUND

1. Field

Embodiments as broadly described herein relate to an air conditioning system.

2. Background

In general, an air conditioning system, which may employ a coolant circulating cycle including a compressor, a condenser, an expansion member and an evaporator, may operate both a cooling cycle and a heating cycle to maintain an inner space temperature higher than an outdoor temperature or lower than an outdoor temperature. Such an air conditioning system may include switch valve such as a 4-way valve to allow selective switching between the cooling cycle and heating cycle. Improvements in these types of air conditioning systems, and in particular, in performance and reliability, would be desirable.

BRIEF DESCRIPTION OF THE DRAWINGS

The embodiments will be described in detail with reference to the following drawings in which like reference numerals refer to like elements wherein.

DETAILED DESCRIPTION

Reference will now be made in detail to the embodiments, examples of which are illustrated in the accompanying drawings.

In the following detailed description, reference is made to the accompanying drawings that form a part hereof, and in which is shown by way of illustration specific embodiments which are described in sufficient detail to enable those skilled in the art to practice the embodiments. It is understood that other embodiments may be utilized and that logical structural, mechanical, electrical, and chemical changes may be made without departing from the spirit or scope as embodied and broadly described herein.

An air conditioner that provides both heating and cooling, such as, for example, a heat pump, operates in a heating mode under low temperature and high humidity conditions in which an outdoor temperature is below approximately 5° C. and humidity is relatively high and in a cooling mode when the outdoor temperature is relatively high. Thus, only one system may be used to provide both heating and cooling.

In the heating mode, frost may accumulate on a surface of an outdoor heat exchanger. And, as time elapses, the frost may be frozen over the surface of the outdoor heat exchanger, determining heat exchange efficiency between outdoor air and coolant.

In order to remove the frost from the outdoor heat exchanger, the outdoor heat exchanger may function as a condenser by operating in reverse of the cooling cycle to thaw the frost frozen over the surface of the outdoor heat exchanger. However, while this reverse cycle is performed, the heating cycle is not performed, thus causing an indoor temperature to drop.

Figure 1:
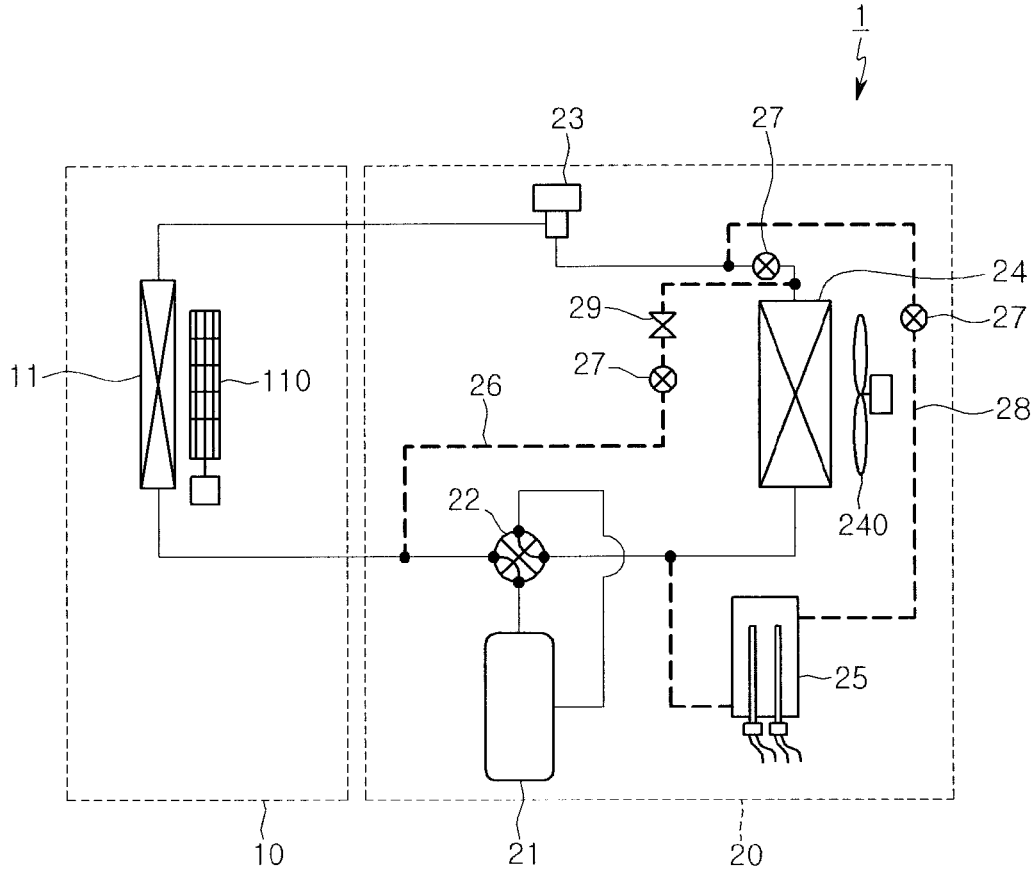
FIG. 1 is a schematic view of an air conditioning system according to an embodiment as broadly described herein.

As shown in FIG. 1, an air conditioning system 1 as embodied and broadly described herein may include an indoor unit 10 and an outdoor unit 20. A cooling cycle of the air conditioning system 1 may include a compressor 21 that compresses coolant at high temperature and high pressure, a 4-way valve 22 that selectively switches directions of coolant flow discharged from the compressor 21, an indoor heat exchanger 11 that is supplied with coolant discharged from the compressor 21 during a heating mode and performs heat exchange with indoor air, an expansion member 23 that converts the coolant from the indoor heat exchanger 11 into 2-phase coolant having low temperature and low pressure, and an outdoor heat exchanger 24 that performs heat exchange with the coolant from the expansion member 23.

The indoor heat exchanger 11 and an indoor fan 110 that draws indoor air toward the indoor heat exchanger 11 may be received in the indoor unit 10. And, the compressor 21, the 4-way valve 22, the expansion member 23, the outdoor heat exchanger 24 and an outdoor fan 240 that draws outdoor air toward the outdoor heat exchanger 24 may be received in the outdoor unit 20. However, the disposition of these constituent elements may be different depending on a particular product and application.

In order to perform a defrosting function without performing a reverse cycle operation while the air conditioning system 1 performs the heating mode, as described above, the following may also be included.

More specifically, a first bypass pipe 26 may extend from a predetermined position between an outlet of the compressor 21 and an inlet of the indoor heat exchanger 11 to an inlet of outdoor heat exchanger 24. A second bypass pipe 28 may extend from a predetermined position between the expansion member 23 and the inlet of the outdoor heat exchanger 24 to an inlet of the compressor 21. A coolant heating device 25 may be provided on a predetermined portion of the second bypass pipe 28 to heat the bypassed coolant. Opening/closing valves 27 such as, solenoid valves or other types of valves as appropriate, may be provided at inlet ends of the bypass pipes 26 and 28 and the outdoor heat exchanger 24 to control flow of the coolant. In alternative embodiments, valve members that can control an amount of bypassed coolant by controlling an opening degree of the bypass pipes 26 and 28 may also be provided on the bypass pipes 26 and 28. A decompression device 29 may be provided on the bypass pipe 26 at an outlet end of the compressor 21 so as to reduce coolant pressure at an outlet end of the expansion member 23.

When the air conditioning system 1 shown in FIG. 1 is operated in a heating mode, high temperature and high pressure coolant passing through the compressor 21 is guided to the indoor heat exchanger 11 by the 4-way valve 22. Coolant that has passed through the indoor heat exchanger 11 is phase-changed into low temperature and low pressure coolant by the expansion member 23. The low temperature and low pressure coolant that has passed through the expansion member 23 flows into the outdoor heat exchanger 24 and performs a heat exchange with outdoor air. Coolant passing through the outdoor heat exchanger 24 absorbs heat from the outdoor air and is converted into a gas having low temperature and low pressure.

When the coolant passing through the outdoor heat exchanger 24 performs a heat exchange with the outdoor air, frost may accumulate on the outdoor heat exchanger 24 as moisture contained in the outdoor air is condensed due to a temperature difference between the outdoor air and the coolant. As time elapses, moisture condensed on the surface of the outdoor heat exchanger 24 is frozen. This frost causes heat exchange efficiency between the coolant inside the outdoor heat exchanger 24 and the outdoor air to deteriorate to the point that liquid coolant may be transferred to the inlet side of the compressor 21. An accumulator (not shown) that separates liquid coolant from gas coolant may be mounted at the inlet side of the compressor 21 so that the liquid coolant may be filtered in the accumulator. Then, an amount of gas coolant that is guided to the compressor 21 may be reduced so that an amount of compression is reduced, thereby deteriorating efficiency of the cooling cycle is deteriorated.

Under these circumstances, a portion of the coolant that has passed through the compressor 21 may be supplied to the first bypass pipe 26 so as to flow into the inlet end of the outdoor heat exchanger 24. In other words, a portion of the coolant that has passed through the compressor 21 is bypassed by opening the opening/closing valve 27 provided on the first bypass pipe 26 or by controlling the opening degree of the first bypass pipe 26. In addition, the opening/closing valve 27 provided between the expansion member 23 and the outdoor heat exchanger 24 is closed and, the opening/closing valve 27 on the second bypass pipe 28 provided on the inlet side of the expansion member 23 is opened or the opening degree thereof is controlled. Then, the coolant that has passed through the expansion member 23 is guided to the second bypass pipe 28 provided on the outlet side of the expansion member 23 and does not flow toward the outside heat exchanger 24. If only a portion of the opening/closing valve 27 is opened, and the second bypass pipe 28 not completely blocked, a portion of the coolant may flow toward the outdoor heat exchanger 24.

Meanwhile, the temperature of the coolant flowing along the second bypass pipe 28 is increased as it passes through the coolant heating device 25, and is phase-changed into gas-phased coolant having low temperature and low pressure. The coolant flowing along the first bypass pipe 26 is reduced by the pressure on the outlet side of the expansion member 23 by the decompression device 29 and the temperature of the decompressed coolant is reduced as it passes through the outdoor heat exchanger 24, but the surface temperature of the outdoor heat exchanger 24 is increased. As a result, ice formed on the surface of the outdoor heat exchanger 24 is thawed, or moisture accumulated on the surface of the outdoor heat exchanger 24 does not have an opportunity to freeze.

More specifically, if the opening degree of the opening/closing valves 27 is properly controlled, portions of the coolant flowing along the first bypass pipe 26 and of the coolant that has passed through the expansion member 23 may be mixed on the inlet side of the outdoor heat exchanger 24. Also, if the opening/closing valve 27 provided between the expansion member 23 and the outdoor heat exchanger 24 is completely closed, the coolant that has passed through the expansion member 23 does not flow into the outdoor heat exchanger 24.

As described above, the defrosting function may be properly performed depending on the thickness of accumulated ice by properly controlling an amount of coolant that flows into the outdoor heat exchanger 24.

Also, the coolant heating device 25 that is mounted on a predetermined portion of the second bypass pipe 28 may have a structure in which a heater is mounted in a coolant storage container to heat coolant gathered in the inside of the coolant storage container. The heater may be, for example, a sheath heater, an induction heater that uses an induction heating method, or other type of heater as appropriate.

Also, in the embodiment shown in FIG. 1, an outlet end of the second bypass pipe 28 is connected to an inlet end of the compressor 21 but in alternative embodiments may be connected to a rear side of the accumulator that separates liquid-phase coolant from gas-phase coolant. In other words, the coolant flowing along the second bypass pipe 28 may be heated by the coolant heating device 25 and then flow into the accumulator.

Figure 2:
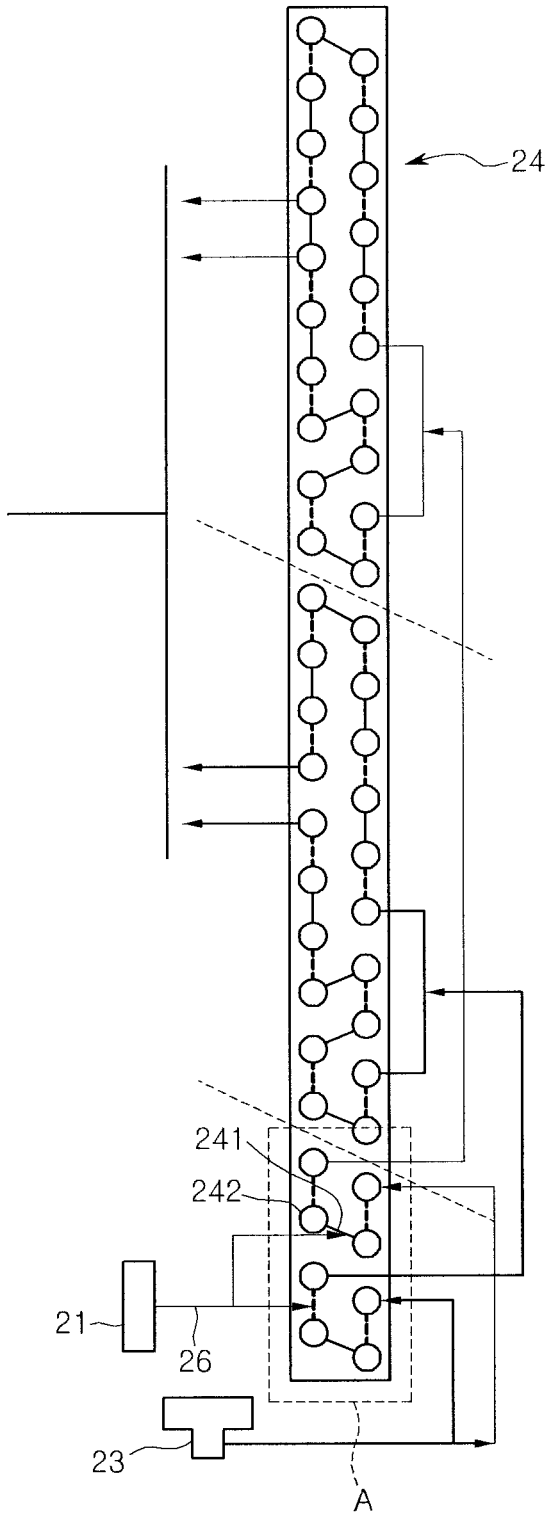
FIGS. 2 and 3 illustrate a bypass pipe on an outlet side of a compressor connected to an outdoor heat exchanger in the air conditioning system shown in FIG. 1.
Figure 3:
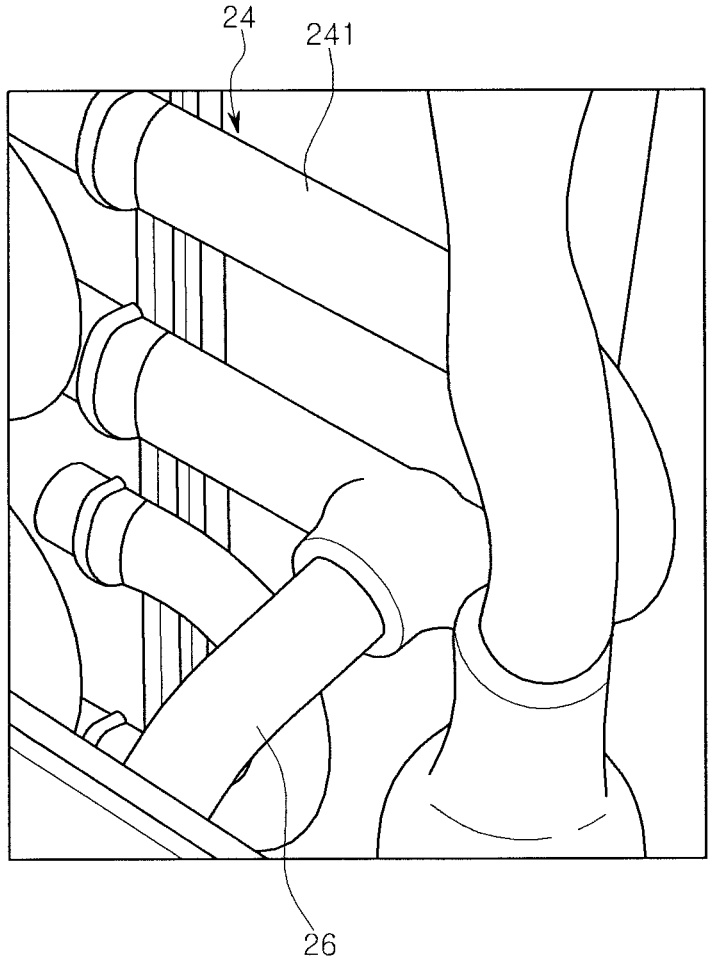

Referring to FIGS. 2 and 3, the first bypass pipe 26 branched from the outlet end of the compressor 21 may be connected to the inlet end of the outdoor heat exchanger 24. More specifically, the outlet end of the first bypass pipe 26 may be connected to a predetermined portion of the pipe on the inlet end of the outdoor heat exchanger 24. Alternatively, as shown in FIG. 3, the outlet end of the first bypass pipe 26 may also be connected directly to a return band 241 that is formed as a curve on an end of the pipe of the outdoor heat exchanger 24 in a U shape. Reference numeral 242 indicates a straight part of the pipe.

As described above, the outlet end of the first bypass pipe 26 may be connected directly to the return band 241 provided on the lower part of the outdoor heat exchanger 24, making it possible to perform a defrost operation promptly. In other words, the first bypass pipe 26 may be connected directly to a super-cooling section A of the outdoor heat exchanger 24 where freezing/ice is mostly commonly accumulated so that the defrosting can be promptly performed, making it possible to improve performance.

An air conditioning system as embodied and broadly described herein removes frost, while continuously performing a heating mode.

An air conditioning system as embodied and broadly described herein may include a compressor that compresses coolant at high temperature and high pressure; an indoor heat exchanger through which coolant discharged from the compressor at a heating mode flows; an expansion member that is provided on an outlet side of the indoor heat exchanger to decompress coolant; an outdoor heat exchanger through which coolant passing through the expansion member flows at the heating mode; a first bypass pipe that is branched from a predetermined position between an outlet of the compressor and an inlet of the indoor heat exchanger to be connected to an inlet side of the indoor heat exchanger; a second bypass pipe that is branched from a predetermined position between an outlet of the expansion member and an inlet of the outdoor heat exchanger to be connected to an inlet side of the compressor; and a coolant heating device that is provided on a predetermined position of the second bypass pipe to heat coolant.

In an air conditioning system as embodied and broadly described herein, the defrosting operation is performed while the heating mode is continued, making it possible to prevent the drop of the indoor temperature.

Also, there is no need to perform the reverse cycle operation for defrosting, making it possible to prevent the compressor from being infiltrated with liquid phase coolant.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioning system, comprising:

a compressor that compresses coolant;

an indoor heat exchanger that receives compressed coolant from the compressor in a heating mode;

an expansion member provided on an outlet side of the indoor heat exchanger to decompress coolant discharged from the indoor heat exchanger;

an outdoor heat exchanger that receives coolant from the expansion member in the heating mode;

a first bypass pipe that extends from a first predetermined position that is between an outlet of the compressor and an inlet of the indoor heat exchanger to an inlet side of the outdoor heat exchanger;

a first valve provided on the first bypass pipe;

a second bypass pipe that extends from a second predetermined position that is between an outlet of the expansion member and an inlet of the outdoor heat exchanger to an inlet side of the compressor;

a second valve provided on the second bypass pipe;

a third valve provided at a position between an outlet end of the first bypass pipe and an inlet end of the second bypass pipe, on a pipe connecting the expansion member to the outdoor heat exchanger; and a coolant heater provided on the second bypass pipe so as to heat coolant flowing therethrough, wherein an outlet end of the first bypass pipe is directly connected to a pipe that forms a lower portion of the outdoor heat exchanger, the lower portion of the outdoor heat exchanger defining a supercooling section.

2. The air conditioning system of claim 1, wherein the first, second and third valves are valves that selectively open and close the first and second bypass pipes, or that control an opening degree of the first and second bypass pipes.

3. The air conditioning system of claim 1, wherein the first, second and third valves each have a plurality of positions including a fully open position, a fully closed position and a partially open position, and wherein the first and second valves respectively provided on the first bypass pipe and the second bypass pipe are both in the fully open position and the third valve is in the fully closed position during a defrosting operation.

4. The air conditioning system of claim 1, wherein the first, second and third valves each have a plurality of positions including a fully open position, a fully closed position and a partially open position, and wherein the first valve provided on the first bypass pipe is in the fully open position and the second and third valves respectively provided on the second bypass pipe and the inlet side of the outdoor heat exchanger are each in the partially open position during a defrosting operation.

5. The air conditioning system of claim 1, wherein the first, second and third valves each have a plurality of positions including a fully open position, a fully closed position and a partially open position, and wherein the first, second and third valves respectively provided on the first bypass pipe, the second bypass pipe and the inlet side of the outdoor heat are each in the partially open position during a defrosting operation.

6. The air conditioning system of claim 1, wherein the coolant heater comprises an induction heater.

7. The air conditioning system of claim 1, further comprising:

an accumulator provided at an inlet side of the compressor to separate liquid-phase coolant from gas-phase coolant, wherein an outlet end of the second bypass pipe is positioned on a rear side of the accumulator based on a flow direction of the coolant.

8. The air conditioning system of claim 1, further comprising a decompression device provided at a predetermined position on the first bypass pipe.

9. The air conditioning system of claim 1, wherein the outlet end of the first bypass pipe is directly connected to a curved pipe at a side of the outdoor heat exchanger.

10. An air conditioning system including a compressor, an indoor heat exchanger in communication with the compressor, an expansion member provided at an outlet side of the indoor heat exchanger, and an outdoor heat exchanger in communication with the expansion member, the air conditioning system further comprising:

a first bypass pipe having a first end positioned between an outlet of the compressor and an inlet of the indoor heat exchanger and a second end connected to an inlet side of the outdoor heat exchanger;

a second bypass pipe having a first end positioned between an outlet of the expansion member and an inlet of the outdoor heat exchanger and a second end connected to an inlet side of the compressor;

first and second valves respectively provided on the first and second bypass pipes and a third valve provided on a pipe connecting the expansion member and the outdoor heat exchanger, and a heater provided on a flowpath of the second bypass pipe so as to heat coolant flowing therethrough, wherein an outlet end of the first bypass pipe is directly connected to a pipe that forms a lower portion of the outdoor heat exchanger, the lower portion of the outdoor heat exchanger defining a supercooling section.

* * * * *